US008109107B2

(12) United States Patent
Narayanamurthy et al.

(10) Patent No.: US 8,109,107 B2
(45) Date of Patent: Feb. 7, 2012

(54) MIXED-PHASE REGULATOR

(75) Inventors: Ramachandran Narayanamurthy, Loveland, CO (US); Robert Scott Hicks, LaPorte, CO (US); Robert K. Kerrigan, Berthoud, CO (US); Christopher A. Kay, Fort Collins, CO (US)

(73) Assignee: Ice Energy, Inc., Windsor, CO (US)

( * ) Notice: Subject to any disclaimer, the term of this patent is extended or adjusted under 35 U.S.C. 154(b) by 0 days.

(21) Appl. No.: 12/719,645

(22) Filed: Mar. 8, 2010

(65) Prior Publication Data

US 2010/0162735 A1 Jul. 1, 2010

Related U.S. Application Data

(62) Division of application No. 11/112,861, filed on Apr. 22, 2005, now Pat. No. 7,690,212.

(60) Provisional application No. 60/564,723, filed on Apr. 22, 2004.

(51) Int. Cl.
*F25B 41/04* (2006.01)
*F25B 41/06* (2006.01)

(52) U.S. Cl. ..... 62/222; 236/92 B

(58) Field of Classification Search ..... 62/222, 62/223, 224, 225; 236/92 B
See application file for complete search history.

(56) References Cited

U.S. PATENT DOCUMENTS

| | | | | |
|---|---|---|---|---|
| 2,512,576 | A | | 6/1950 | Cross |
| 3,156,101 | A | | 11/1964 | McGuffey |
| 3,746,084 | A | | 7/1973 | Ostbo |
| 3,952,533 | A | * | 4/1976 | Johnston et al. ..... 62/115 |
| 4,073,306 | A | | 2/1978 | Neyer |
| 4,294,078 | A | | 10/1981 | MacCracken |
| 4,403,645 | A | | 9/1983 | MacCracken |
| 4,565,069 | A | | 1/1986 | MacCracken |
| 4,608,836 | A | | 9/1986 | MacCracken et al. |
| 4,609,036 | A | | 9/1986 | Schrader |
| 4,619,317 | A | | 10/1986 | Disselbeck et al. |
| 4,735,064 | A | | 4/1988 | Fischer |
| 4,893,476 | A | | 1/1990 | Bos et al. |
| 4,916,916 | A | | 4/1990 | Fischer |
| 4,940,079 | A | | 7/1990 | Best et al. |
| 4,964,279 | A | | 10/1990 | Osborne |
| 5,005,368 | A | | 4/1991 | MacCracken et al. |
| 5,109,920 | A | | 5/1992 | Merryfull |
| 5,211,029 | A | | 5/1993 | Uselton et al. |

(Continued)

FOREIGN PATENT DOCUMENTS

DE 10057834 9/1957

(Continued)

OTHER PUBLICATIONS

U.S. Appl. No. 11/112,861, Notice of Allowance, Nov. 19, 2009, pp. 1-7.

(Continued)

*Primary Examiner* — Marc Norman
(74) *Attorney, Agent, or Firm* — Paul M. Thompson; Cochran Freund & Young LLC

(57) ABSTRACT

Disclosed is a method and device to efficiently regulate flow of refrigerant while maintaining a sealed chamber in systems providing stored thermal energy for use during peak electrical demand. A mixed-phase regulator replaces the thermostatic expansion valve used in conventional air-conditioning systems that, along with capillary tubes and orifices, regulates the refrigerant fed from the compressor to the heat load.

11 Claims, 4 Drawing Sheets

U.S. PATENT DOCUMENTS

| | | | | |
|---|---|---|---|---|
| 5,237,832 | A | | 8/1993 | Alston |
| 5,255,526 | A | | 10/1993 | Fischer |
| 5,366,153 | A | | 11/1994 | Swenson |
| 5,383,339 | A | | 1/1995 | McCloskey et al. |
| 5,423,378 | A | | 6/1995 | Dillenbeck et al. |
| 5,467,812 | A | | 11/1995 | Dean et al. |
| 5,598,720 | A | | 2/1997 | MacCracken et al. |
| 5,647,225 | A | | 7/1997 | Fischer et al. |
| 5,678,626 | A | | 10/1997 | Gilles |
| 5,682,752 | A | | 11/1997 | Dean |
| 5,687,578 | A | | 11/1997 | Cochran |
| 5,720,178 | A | | 2/1998 | Silvetti et al. |
| 6,076,368 | A | * | 6/2000 | Noble ..... 62/217 |
| 6,112,543 | A | | 9/2000 | Feuerecker et al. |
| 6,158,499 | A | | 12/2000 | Rhodes et al. |
| 6,247,522 | B1 | | 6/2001 | Kaplan et al. |
| 6,250,098 | B1 | | 6/2001 | Huang |
| 6,260,376 | B1 | | 7/2001 | Khelifa et al. |
| 6,325,101 | B1 | | 12/2001 | Stoll et al. |
| D501,490 | S | | 2/2005 | Kerrigan |
| 6,935,126 | B2 | | 8/2005 | Ito et al. |
| 7,124,594 | B2 | | 10/2006 | McRell |
| 7,162,878 | B2 | | 1/2007 | Narayanamurthy et al. |
| 7,503,185 | B2 | | 3/2009 | Narayanamurthy et al. |
| 7,690,212 | B2 | | 4/2010 | Narayanamurthy et al. |
| 2002/0162342 | A1 | | 11/2002 | Weng et al. |

FOREIGN PATENT DOCUMENTS

| | | | |
|---|---|---|---|
| DE | 29823175 | | 7/1999 |
| DE | 19831127 | | 3/2001 |
| DE | 1015019 | | 6/2002 |
| EP | 0641978 | | 3/1995 |
| EP | 1 143 212 | | 10/2001 |
| EP | 1441183 | | 7/2004 |
| JP | 58217133 | | 12/1983 |
| JP | A-2000-266368 | | 1/1996 |
| JP | 8-226682 | | 9/1996 |
| JP | 10184983 | | 7/1998 |
| JP | A-2001-296068 | | 12/1998 |
| JP | 8014628 | | 9/2000 |
| JP | 10339483 | A | 9/2000 |
| JP | A-2000-249420 | | 10/2001 |
| JP | 2002349732 | | 12/2002 |
| WO | WO 96/11369 | | 4/1996 |

OTHER PUBLICATIONS

U.S. Appl. No. 11/112,861, Non-Final Office Action, Mar. 18, 2008, pp. 1-16.

U.S. Appl. No. 11/112,861, Final Office Action, Oct. 3, 2008, pp. 1-5.

U.S. Appl. No. 11/112,861, Advisory Action, Dec. 31, 2008, pp. 1-3.

U.S. Appl. No. 11/112,861, Non-Final Office Action, Mar. 31, 2009, pp. 1-5.

PCT Application No. PCT/US2005/013903, Notification of Transmittal of the International Search Report and the Written Opinion of the International Searching Authority or the Declaration, Aug. 31, 2005, pp. 1-14.

* cited by examiner

MIXED-PHASE REGULATOR

CROSS REFERENCE TO RELATED APPLICATIONS

This application is a Divisional of patent application Ser. No. 11/112,861, which was filed on Apr. 22, 2005, which claimed the benefit of Provisional Patent Application No. 60/564,723, entitled "Mixed-Phase Flow Regulator for Managing Coolant in a Refrigerant Based High Efficiency Energy Storage and Cooling System", filed Apr. 22, 2004, the entire disclosures of which are hereby specifically incorporated by reference for all that they disclose and teach.

BACKGROUND OF THE INVENTION

1. Field of the Invention

The present invention relates generally to regulating flow of refrigerant in air conditioning units and more specifically to regulating flow of refrigerant in systems providing stored thermal energy for use during peak electrical demand.

2. Description of the Background

With the increasing demands on peak demand power consumption, ice storage has been utilized to shift air conditioning power loads to off-peak times and rates. A need exists not only for load shifting from peak to off-peak periods, but also for increases in unit capacity and efficiency. Current air conditioning units having energy storage systems have had limited success due to several deficiencies including reliance on water chillers that are practical only in large commercial buildings and difficulty in achieving high efficiency. In order to commercialize advantages of thermal energy storage in large and small commercial buildings, the thermal energy storage system must have minimal manufacturing costs, maintain maximum efficiency under varying operating conditions, emanate reliability and simplicity in the refrigerant management design, and maintain flexibility in multiple refrigeration or air conditioning applications.

Systems for providing stored thermal energy have been previously contemplated in U.S. Pat. No. 4,735,064 and U.S. Pat. No. 4,916,916 both issued to Harry Fischer, U.S. Pat. No. 5,647,225 issued to Fischer et al, and U.S. patent application Ser. No. 10/967,114 filed Oct. 15, 2004, by Narayanamurthy et al. All of these patents utilize ice storage to shift air conditioning loads from on-peak to off-peak electric rates to provide economic justification and are hereby incorporated by reference for all they teach and disclose.

SUMMARY OF THE INVENTION

The present invention overcomes the disadvantages and limitations of the prior art by providing a mixed-phase regulator that regulates the pressure/flow of a refrigerant between an inlet and outlet of the controller.

An embodiment of the present invention may therefore comprise a closed system for regulating pressure and flow of a refrigerant comprising: a mixed-phase regulator that regulates pressure of the refrigerant between an inlet of the controller and an outlet of the controller, the controller having a variable orifice valve that regulates the pressure of the refrigerant at the outlet substantially independent of temperature and vapor content of the refrigerant.

An embodiment of the present invention may also comprise a method of controlling pressure and flow of a refrigerant comprising: regulating pressure of the refrigerant by controlling the flow of the refrigerant through a mixed-phase regulator between an inlet of the controller and an outlet of the controller substantially independent of temperature and vapor content of the refrigerant.

An embodiment of the present invention may also comprise a refrigerant circuit comprising: a compressor that compresses a low-pressure vapor-phase refrigerant to create a high-pressure vapor-phase refrigerant; a condenser that receives, condenses and draws heat from the high-pressure vapor-phase refrigerant from the compressor to create a high-pressure liquid-phase refrigerant; an evaporator that expands the low-pressure liquid-phase refrigerant within the evaporating unit to create the low-pressure vapor-phase refrigerant and produce cooling in a load; and, a mixed-phase regulator that receives the high-pressure liquid-phase refrigerant from the condenser and reduces the pressure of the high-pressure liquid-phase refrigerant to create a low-pressure liquid-phase refrigerant that is distributed to the evaporator; the mixed-phase regulator that controls vapor content of the refrigerant distributed to the evaporator and controls the amount of subcooling of the refrigerant by the condenser, thereby controlling the refrigeration circuit.

An embodiment of the present invention may also comprise a method of controlling a refrigerant circuit comprising: compressing a low-pressure vapor-phase refrigerant to create a high-pressure vapor-phase refrigerant with a compressor; receiving the high-pressure vapor-phase refrigerant from the compressor; condensing and drawing heat from the high-pressure vapor-phase refrigerant to create a high-pressure liquid-phase refrigerant; receiving the high-pressure liquid-phase refrigerant from the condenser with a mixed-phase regulator; reducing the pressure of the high-pressure liquid-phase refrigerant with the mixed-phase regulator to create a low-pressure liquid-phase refrigerant; receiving the low-pressure liquid-phase refrigerant from the mixed-phase regulator with an evaporator; expanding the low-pressure liquid-phase refrigerant in the evaporator to create the low-pressure vapor-phase refrigerant and produce cooling in a load; and, controlling the refrigerant circuit with the mixed-phase regulator by controlling vapor content of the refrigerant received by the evaporator, and controlling the amount of subcooling produced by the condenser.

DETAILED DESCRIPTION OF THE INVENTION

Figure 1:
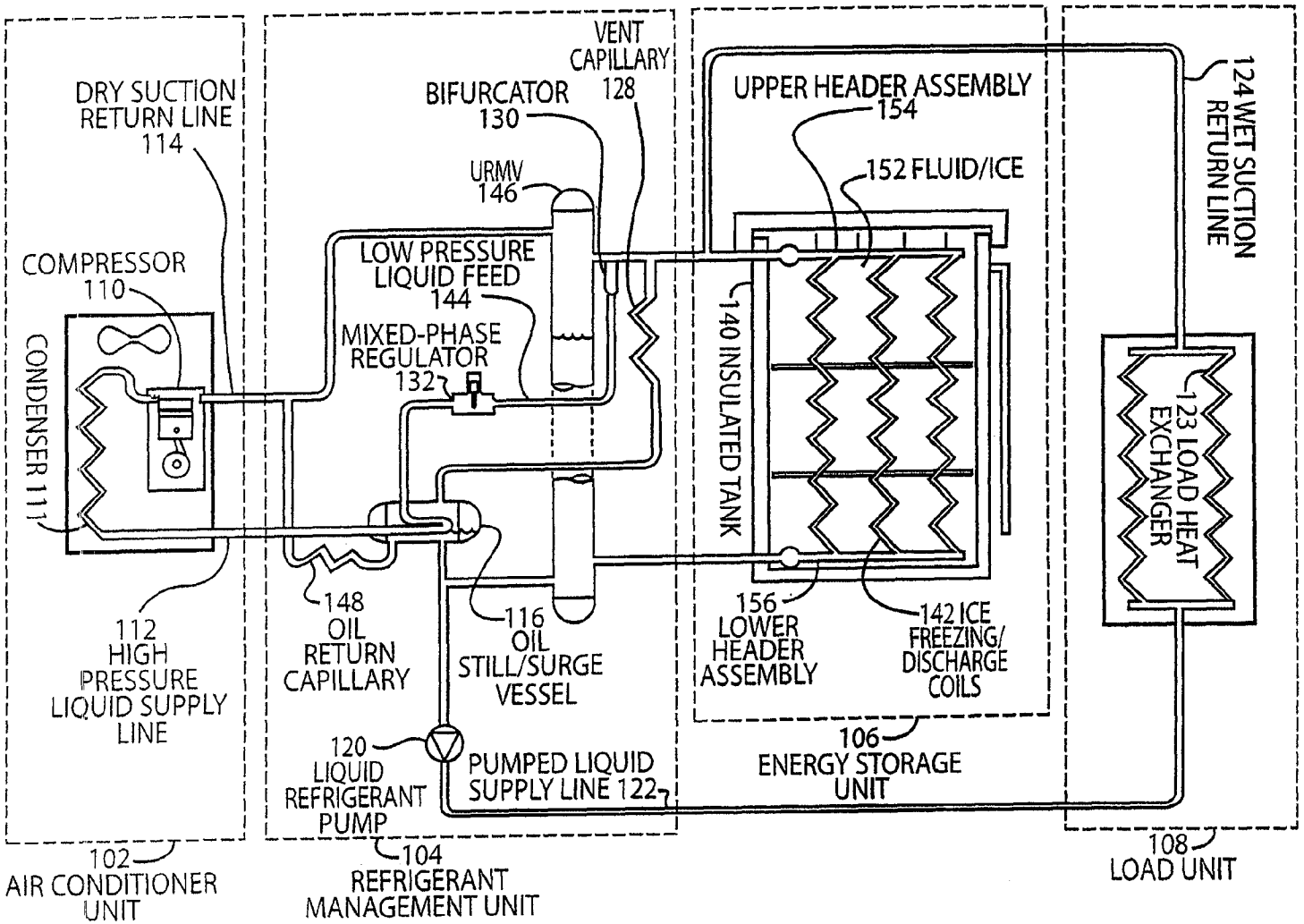
FIG. 1 illustrates an embodiment of a high efficiency refrigerant energy storage and cooling system utilizing a mixed-phase regulator.

While this invention is susceptible to embodiment in many different forms, there is shown in the drawings and will be described herein in detail specific embodiments thereof with the understanding that the present disclosure is to be considered as an exemplification of the principles of the invention and is not to be limited to the specific embodiments described.

FIG. 1 illustrates an embodiment of a high efficiency refrigerant energy storage and cooling system utilizing a mixed-phase regulated flow controller or mixed-phase regulator. The described embodiments minimize additional components and use very little energy beyond that used by an air conditioner unit (condensing unit) to store the energy. The refrigerant energy storage design has been engineered to provide flexibility so that it is practicable for a variety of applications. In conventional air conditioning systems, a thermostatic expansion valve is used, along with capillary tubes and orifices, to regulate the refrigerant feed from the compressor to the heat load. To increase efficiency over thermostatic expansion valve systems, gravity recirculated or liquid overfeed systems that supply refrigerant that is nearly entirely liquid instead of a liquid-vapor mixture to the evaporator have been contemplated. However, gravity recirculated or liquid overfeed systems do not permit usage of a thermostatic expansion valve due to absence of superheated refrigerant for direct feedback.

A mixed-phase regulator has therefore been developed for utilization in a gravity recirculated or liquid overfeed system to regulate the pressure of refrigerant in the cooling system, which cannot use a thermostatic expansion valve because of an absence of direct feedback. The gravity recirculated, liquid overfeed, or other refrigeration systems derives its refrigeration capacity from a standard air conditioner unit, consisting of a compressor followed by a condenser. These systems utilize refrigerant which is a material that can be used to transfer heat from a lower to a higher temperature medium by absorbing work input and through a series of phase change operations.

The design of the mixed-phase regulator is such that a valve (orifice) opens to release liquid-phase refrigerant, only when there is sufficient pressure built up on the input (compressor) side. In this way, the compressor (the main power draw) needs to operate only to feed cold liquid, which is matched to the cooling load. Therefore, the mixed-phase regulator reduces vapor feed to the accumulator from the compressor, while also dropping the pressure of the refrigerant from the condenser pressure to the evaporator saturation pressure. This results in a greater overall efficiency of the system while simplifying the refrigerant management within the gravity recirculated or liquid overfeed system. The disclosed mixed-phase regulator can also be readily incorporated within any type of gravity-fed refrigerant system that incorporates a suction accumulator on the compressor or some other device that prevents liquid from reaching the compressor. This system could include, but is not limited to, an air conditioner, cooler, refrigerator, freezer, process cooling equipment or the like.

The disclosed embodiments prevent vapor lock through a small intermittent vapor bleed and offer the advantage of not requiring feedback from the exit of the evaporator coil as is necessary in normal cooling systems. The mixed-phase regulator allows flexibility in head pressure of air conditioner units, and thus, enables operation at low ambient temperature conditions without any ambient control kits. Head pressure within the air conditioner unit is allowed to "float" (vary with refrigerant pressure) during low (i.e., <50° F.) ambient temperature conditions. Standard thermostatic expansion valves typically require a pressure differential of at least 100 PSI to operate properly. Hence, the mixed-phase regulator avoids the need for head pressure controls. The mixed-phase regulator ensures passage of very little vapor from the high-pressure side to the low-pressure side of the system compared to standard systems, and eliminates leakage of refrigerant during adjustments. The mixed-phase regulator effectively drains liquid refrigerant out of the air conditioner unit to keep it operating efficiently and additionally provides a pulsing action to the refrigerant in the heat exchanger. This pulsing action keeps the refrigerant agitated and increases the condensing heat transfer coefficient within the heat exchanger, thereby improving the heat transfer efficiency of the system.

The described embodiments can utilize stored thermal energy (thermal capacity) to provide chilled water for large commercial applications or provide direct refrigerant air conditioning to multiple evaporators. The design incorporates multiple operating modes, the ability to add optional components, and the integration of smart controls that guarantee energy is stored at maximum efficiency. When connected to a condensing unit, the system stores refrigeration energy (by freezing water) in a first time period, and utilizes the stored thermal capacity during a second time period to provide cooling (by melting ice).

As shown in FIG. 1, an embodiment of a high efficiency refrigerant energy storage and cooling system is depicted comprising the four major components that define the system. The air conditioner unit 102 is a conventional condensing unit that utilizes a compressor 110 and a condenser 111 to produce high-pressure liquid refrigerant delivered through a high-pressure liquid supply line 112 to the refrigeration management system 104. The refrigeration management unit 104 is connected to an energy storage assembly 106 comprising an insulated tank 140 filled with water and ice-making coils 142. The air conditioner unit 102, the refrigeration management system 104 and the energy storage unit 106 act in concert to provide efficient multi-mode cooling to the load heat exchanger 108 (indoor cooling coil assembly) and thereby perform the functions of the principal modes of operation of the system.

As further illustrated in FIG. 1, during one time period (ice building) the air conditioner unit 102 produces high-pressure liquid refrigerant delivered through a high-pressure liquid supply line 112 to the refrigeration management system 104. The high-pressure liquid supply line 112 passes through an oil still/surge vessel 116 forming a heat exchanger therein. The oil still/surge vessel 116 serves a trilogy of purposes: it is used to concentrate the oil in the low-pressure refrigerant to be returned to the compressor 110 through the oil return capillary 148 and dry suction return 114; it is used to store liquid refrigerant during the second time period (cooling mode); and, it is used to prevent a liquid floodback to compressor 110 immediately following compressor 110 startup due to a rapid swelling of refrigerant within the ice freezing/discharge coils 142 and the universal refrigerant management vessel 146. Without the oil still/surge vessel 116, oil would remain in the system and not return to the compressor 110, ultimately causing the compressor 110 to seize due to lack of oil, and the heat exchangers also become less effective due to fouling. Without the oil still/surge vessel 116, it may not be possible to adequately drain liquid refrigerant from the ice freezing/discharge coils during the second time period (cooling mode) in order to utilize nearly the entire heat transfer surface inside the ice freezing/discharge coils 142 for condensing the refrigerant vapor returning from the load heat exchanger 123.

Cold liquid refrigerant comes into contact with an internal heat exchanger that is inside of oil still/surge vessel 116, a high-pressure (warm) liquid resides inside of the internal heat exchanger. A vapor forms which rises to the top of the still/surge vessel 116 and passes out vent capillary 128 (or an orifice), to be re-introduced into the wet suction return 124. The length and internal diameter of the vent capillary 128 limits the pressure in the oil still/surge vessel 116 and the mass quantity of refrigerant inside the oil still/surge vessel 116 during an ice building time period.

When activated during a second time period, a liquid refrigerant pump 120 supplies the pumped liquid supply line 122 with refrigerant liquid which then travels to the evaporator coils of the load heat exchanger 123 within the load portion 108 of the energy storage and cooling system. Low-pressure refrigerant returns from the evaporator coils of the load heat exchanger 123 via wet suction return 124 to an accumulator or universal refrigerant management vessel (URMV) 146. Simultaneously, the partially distilled oil enriched refrigerant flows out the bottom of the oil still/surge vessel 116 through an oil return capillary 148 and is re-introduced into the dry suction return 114 with the low-pressure vapor exiting the universal refrigerant management vessel 146 and returns to the air conditioner unit 102. The oil return capillary 148 controls the rate at which oil-rich refrigerant exits the oil still/surge vessel 116. The oil return capillary, which is also heated by the warm high-pressure liquid refrigerant inside the high-pressure liquid supply line 112, permits the return of oil to the oil sump inside compressor 110.

Additionally, the wet suction return 124 connects with the upper header assembly 154 that connects with bifurcator 130 to supply low-pressure refrigerant to the system from the mixed-phase regulator 132. The mixed-phase regulator 132 meters the flow of refrigerant within the system by incorporating a valve (orifice) that pulses open to release liquid-phase refrigerant, only when there is sufficient quantity of liquid within the condenser 111. This mixed-phase regulator 132 reduces superfluous vapor feed (other than flash gas which forms when the pressure of saturated high-pressure liquid decreases) to the universal refrigerant management vessel 146 from the compressor 110, while also dropping the required pressure from the condenser pressure to the evaporator saturation pressure. This results in greater overall efficiency of the system while simplifying the refrigerant management portion 104 of the gravity recirculated or liquid overfeed system. It is therefore beneficial to have a regulated flow controller that can regulate the pressure output, or meter the flow of the refrigerant, by controlling the flow independently of temperature and vapor content of the refrigerant. This pressure, or flow control, is performed without separate feedback from other parts of the system, such as is performed with conventional thermal expansion valves.

The insulated tank 140 contains dual-purpose ice freezing/discharge coils 142 arranged for gravity recirculation and drainage of liquid refrigerant and that are connected to an upper header assembly 154 at the top, and to a lower header assembly 156 at the bottom. The upper header assembly 154 and the lower header assembly 156 extend outward through the insulated tank 140 to the refrigeration management unit 104. When refrigerant flows through the ice freezing/discharging coils 142 and header assemblies 154 and 156, the coils act as an evaporator while the fluid/ice 152 solidifies in the insulated tank 140 during one time period. The ice freezing/discharging coils 142 and header assemblies 154 and 156 are connected to the low-pressure side of the refrigerant circuitry and are arranged for gravity recirculation and drainage of liquid refrigerant. During a second time period, warm vapor-phase refrigerant circulates through the ice freezing/discharging coils 142 and header assemblies 154 and 156 and condenses the refrigerant, while melting the ice.

The refrigerant management unit 104 includes the universal refrigerant management vessel 146 which functions as an accumulator. The universal refrigerant management vessel 146 is located on the low-pressure side of the refrigerant circuitry and performs several functions. The universal refrigerant management vessel 146 separates the liquid-phase from the vapor-phase refrigerant during the refrigerant energy storage period and again during the cooling period. The universal refrigerant management vessel 146 also provides a static column of liquid refrigerant during the refrigerant energy storage period that sustains gravity circulation through the ice freezing/discharge coils 142 inside the insulated tank 140. The dry suction return 114 provides low-pressure vapor-phase refrigerant to compressor 110, within the air conditioner unit 102, during a first energy storage time period from an outlet at the top of the universal refrigerant management vessel 146. A wet suction return 124 is provided through an inlet in the top of the upper header assembly 154 for connection to an evaporator (load heat exchanger 123) during the second time period when the refrigerant energy storage system provides cooling.

The first time period is the refrigerant energy storage time period in which sensible heat and latent heat are removed from water causing the water to freeze. The output of the compressor 110 is high-pressure refrigerant vapor that is condensed to form high-pressure liquid. A valve (not shown) on the outlet of the liquid refrigerant pump 120 (in the pumped liquid supply line 122) controls the connection to the load unit 108, for example closing the connection when the liquid refrigerant pump is stopped. During the first time period, heat flows from high-pressure warm liquid to the low-pressure cold liquid inside the oil still/surge vessel 116 which boils the cold liquid. The pressure rise resulting from the vapor that forms during liquid boiling inside the oil still/surge vessel 116 causes the cold liquid to exit the oil still/surge vessel 116 and moves it to the ice freezing/discharge coils 142 where it is needed for proper system operation during the first time period. During the second time period, warm high-pressure liquid no longer flows through the high-pressure liquid supply line 112 because the compressor 110 inside air conditioner unit 102 is off. Therefore, the aforementioned heat flow from warm liquid to cold liquid ceases. This cessation permits liquid from the universal refrigerant management vessel 146 and ice freezing/discharge coils to flow back into the oil still/surge vessel 116 because the high internal vessel gas pressure during the first time period no longer exists.

During the energy storage period, high-pressure liquid refrigerant flows from the air conditioner unit 102 to an internal heat exchanger, which keeps all but a small amount of low-pressure liquid refrigerant out of the oil still/surge vessel 116. The refrigerant that is inside the vessel boils at a rate determined by two capillary tubes (pipes). One capillary is the vent capillary 128 that controls the level of refrigerant in the oil still/surge vessel 116. The second, the oil return capillary 148, returns oil-enriched refrigerant to the compressor 110 within the air conditioner unit 102 at a determined rate. The column of liquid refrigerant in the universal refrigerant management vessel 146 is acted on by gravity and positioning the oil still/surge vessel 116 near the bottom of the universal refrigerant management vessel 146 column maintains a steady flow of supply liquid refrigerant to the oil still/surge vessel 116 and into the energy storage unit 106. The surge function allows excess refrigerant during the cooling period to be drained from the ice freezing/discharging coils 142 that are in the insulated tank 140, keeping the surface area maximized for condensing refrigerant during the second time period.

The physical positioning of the oil still/surge vessel 116, in reference to the rest of the system, is a performance factor as an oil still and as a surge vessel. This oil still/surge vessel 116 additionally provides the path for return of the oil that migrates with the refrigerant that must return to the compressor 110. The slightly subcooled (cooler than the vapor-to-liquid phase temperature of the refrigerant) high-pressure liquid refrigerant that exits the oil still/surge vessel 116 flows through a mixed-phase regulator 132 during which a pressure drop occurs.

As stated above, the refrigerant management unit 104 receives high-pressure liquid refrigerant from the air conditioner unit 102 via a high-pressure liquid supply line 112. The high-pressure liquid refrigerant flows through the heat exchanger within the oil still/surge vessel 116, where it is slightly subcooled, and then flows to the mixed-phase regulator 132, where the refrigerant pressure drop takes place. The use of a mixed-phase regulator 132 provides many favorable functions besides liquid refrigerant pressure drop. The mass quantity of refrigerant that passes through the mixed-phase regulator 132 matches the refrigerant boiling rate inside the ice making coils 142 during the energy storage time period, thereby, eliminating the need for a refrigerant level control.

The mixed-phase regulator 132 passes liquid refrigerant, but closes when sensing vapor. The existence of vapor on the low side of the regulator creates pressure to close the valve which combines with the other forces acting upon the piston, to close the piston at a predetermined trigger point that corresponds to desired vapor content. This trigger point may be predetermined by regulator design (i.e., changing the geometry of the regulator components as well as the materials). The trigger point may also be adjusted by automatic or manual adjustments to the regulator geometry (i.e., threaded adjustment to the piston displacement limits).

The pulsing action created in the refrigerant exiting the mixed-phase regulator 132 as a result of the opening and closing of the mixed-phase regulator 132 creates a pulsing effect upon the liquid refrigerant that creates a pressure wave within the closed column in the URMV 146. This agitates the liquid refrigerant in both the ice making coils 142 and the condenser 111 during the energy storage first time period, and enhances heat transfer as well as assists in segregating liquid and vapor-phase refrigerant. The mixed-phase regulator 132, in conjunction with the universal refrigerant management vessel 146, also drains the air conditioner unit 102 of liquid refrigerant during the first time period keeping its condensing surface area free of liquid condensate and therefore available for condensing. The mixed-phase regulator 132 allows head pressure of the air-cooled air conditioner unit 102 to float with ambient temperature. The system does not require a superheat circuit, which is necessary with most condensing units connected to a direct expansion refrigeration device.

The low-pressure mixed-phase refrigerant that leaves the mixed-phase regulator 132 passes through a bifurcator 130 to an eductor (or injector nozzle), located between the inlet, to the universal refrigerant management vessel 146 and the upper header assembly 154 of the ice making coils 142, to assist with gravity refrigerant circulation. During the refrigerant energy storage time period, the eductor creates a drop in pressure immediately upstream from the eductor, and in the upper header assembly 154 of the energy storage unit 106, as the refrigerant leaves the bifurcator 130, thereby increasing the rate of refrigerant circulation in the ice making coils 142 while simultaneously improving system performance.

The mixed-phase regulator 132 also reacts to changes in refrigerant mass flow from compressor 110 as the pressure difference across its outlet port varies with increasing or decreasing outdoor ambient air temperatures. This allows the condensing pressure to float with the ambient air temperature. As the ambient air temperature decreases, the head pressure at the compressor 110 decreases which reduces energy consumption and increases compressor 110 capacity. The mixed-phase regulator 132 allows liquid refrigerant to pass while closing a piston upon sensing vapor. Therefore, the mixed-phase regulator 132 temporarily holds the vapor-phase mixture in a "trap". Upon sensing high-pressure liquid, the piston lifts from its seat which allows liquid to pass.

The mixed-phase regulator 132 therefore, allows vapor pressure to convert high-pressure liquid refrigerant to low-pressure liquid refrigerant and flash vapor. The vapor held back by the mixed-phase regulator 132 increases the line pressure back to the condenser 111 and is further condensed into a liquid. The mixed-phase regulator 132 is self regulating and has no parasitic losses. Additionally, the mixed-phase regulator 132 improves the efficiency of the heat transfer in the coils of the heat exchangers by removing vapor out of the liquid and creating a pulsing action on both the low-pressure and high-pressure sides of the system. As stated above, the mixed-phase regulator opens to let low-pressure liquid through and then closes to trap vapor on the high-pressure side and creates a pulsing action on the low-pressure side of the regulator. This pulsing action wets more of the inside wall of the heat exchanger at the boiling and condensing level, which aids in the heat transfer.

The low-pressure mixed-phase refrigerant enters the universal refrigerant management vessel 146 and the liquid and vapor components are separated by gravity with liquid falling to the bottom and vapor rising to the top. The liquid component fills the universal refrigerant management vessel 146 to a level determined by the mass charge of refrigerant in the system, while the vapor component is returned to the compressor of the air conditioner unit 102. In a normal direct expansion cooling system, the vapor component circulates throughout the system reducing efficiency. With the embodiment depicted in FIG. 1, the vapor component is returned to the compressor 110 directly without having to pass though the evaporator. The column of liquid refrigerant in the universal refrigerant management vessel 146 is acted upon by gravity and has two paths during the energy storage time period. One path is to the oil still/surge vessel 116 where the rate is metered by capillary tubes 128 and 148.

The second path for the column of liquid refrigerant is to the lower header assembly 156, through the ice freezing/discharge coils 142 and the upper header assembly 154, and back to the compressor 110 through the universal refrigerant management vessel 146. This gravity assisted circulation stores thermal capacity in the form of ice when the tank is filled with a phase-change fluid such as water. The liquid static head in the universal refrigerant management vessel 146 acts as a pump to create a flow within the ice freezing/discharge coils 142. As the refrigerant becomes a vapor, the level of liquid in the coil is forced lower than the level of the liquid in the universal refrigerant management vessel 146, and therefore, promotes a continuous flow between the universal refrigerant management vessel 146 through ice freezing/discharge coils 142. This differential pressure between the universal refrigerant management vessel 146 and the ice freezing/discharge coils 142 maintains the gravity circulation. Initially vapor only, and later (in the storage cycle), both refrigerant liquid and vapor, are returned to the universal refrigerant management vessel 146 from the upper header assembly 154.

As refrigerant is returned to the universal refrigerant management vessel 146 the heat flux gradually diminishes due to increasing ice thickness (increasing thermal resistance). The liquid returns to the universal refrigerant management vessel 146 within the refrigerant management unit 104 and the vapor returns to the compressor 110 within the air conditioner unit 102. Gravity circulation assures uniform building of the ice. As one of the ice freezing/discharge coils 142 builds more ice, its heat flux rate is reduced. The coil next to it now receives more refrigerant until all coils have a nearly equal heat flux rate.

The design of the ice freezing/discharge coils 142 creates an ice build pattern that maintains a high compressor suction pressure (therefore an increased suction gas density) during the ice build storage (first) time period. During the final phase of the energy storage (first) time period, all remaining interstices between each ice freezing/discharge coil 142 become closed with ice, therefore the remaining water to ice surface area decreases, and the suction pressure drops dramatically. This drop on suction pressure can be used as a full charge indication that automatically shuts off the condensing unit with an adjustable refrigerant pressure switch.

When the air conditioner unit 102 turns on during the energy storage first time period, low-pressure liquid refrigerant is prevented from passing through the liquid refrigerant pump 120 by gravity, and from entering the load heat exchanger 123 by a poppet valve (not shown) in the pumped liquid supply line 122. When the energy storage system is fully charged, and the air conditioning unit 102 shuts off, the mixed-phase regulator 132 allows the refrigerant system pressures to equalize quickly. This rapid pressure equalization permits use of a high efficiency, low starting torque motor in the compressor 110. The load heat exchanger 123 is located either above or below the energy storage system so that refrigerant may flow from the load heat exchanger 123 (as mixed-phase liquid and vapor), or through the wet suction return 124 (as vapor only at saturation), to the upper header assembly 154. After passing through the upper header assembly 154 it then passes into the ice freezing/discharge coils for condensing back to a liquid.

Figure 2:
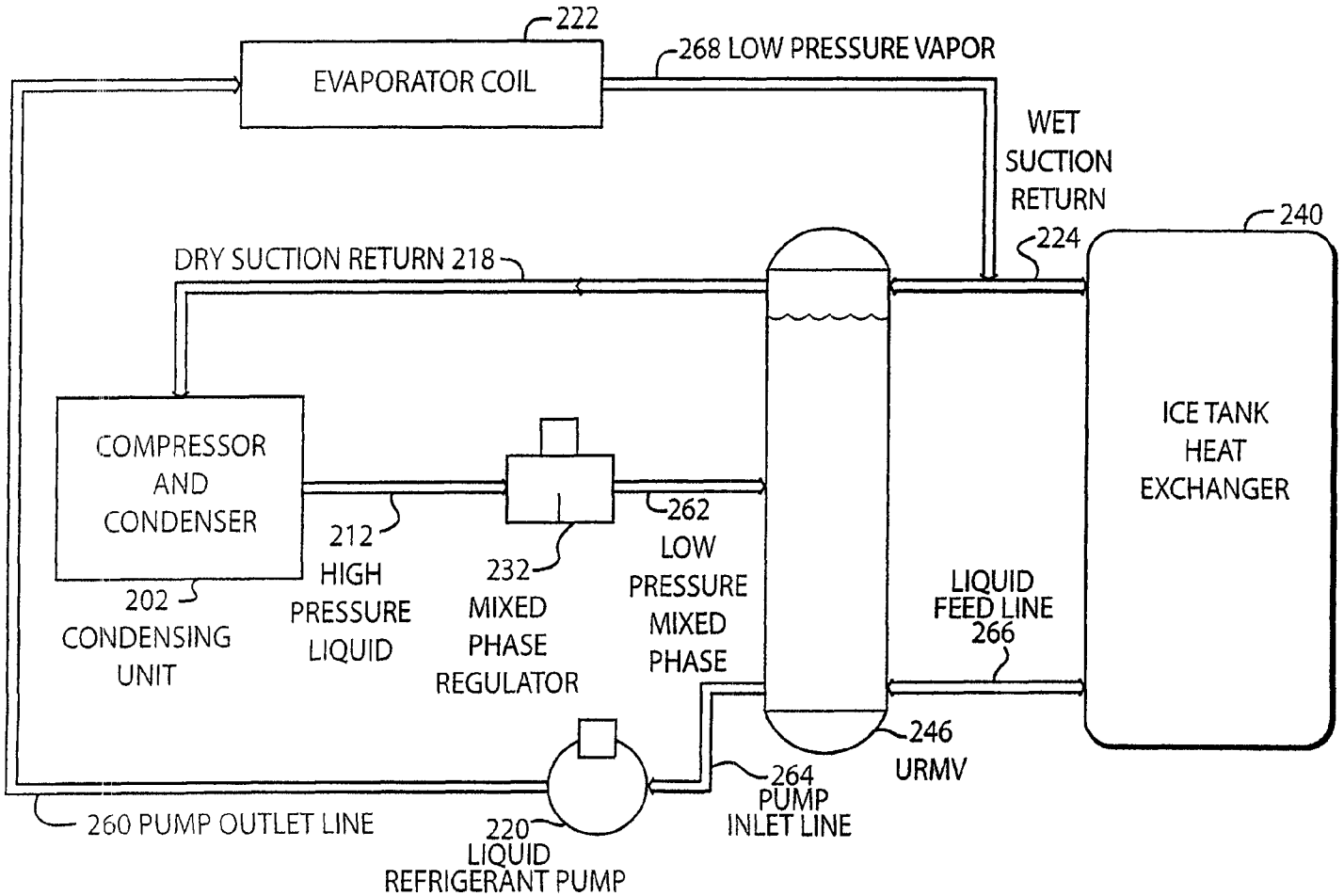
FIG. 2 illustrates an embodiment of a high efficiency refrigerant energy storage and cooling system utilizing a mixed-phase regulator.

FIG. 2 illustrates an embodiment of a mixed-phase flow regulator for managing coolant in a refrigerant based high efficiency energy storage and cooling system. An energy storage and cooling system with a conventional condensing unit 202 utilizes a compressor and condenser to produce high-pressure liquid refrigerant delivered through a high-pressure liquid supply line 212 to the mixed-phase flow regulator 232. The mixed-phase flow regulator 232 is used to control and regulate the flow of refrigerant fed from a compressor to the heat load. Low-pressure mixed-phase refrigerant 262 leaves the mixed-phase flow regulator 232, and is accumulated in a universal refrigerant management vessel 246 that separates the liquid-phase refrigerant from the vapor-phase refrigerant. The mixed-phase regulator 232 is used to minimize vapor feed to the universal refrigerant management vessel 246 from the compressor, while decreasing the refrigerant pressure difference from the condenser to the evaporator saturation pressure.

The design of the mixed-phase flow regulator 232 is such that a valve (orifice) within the unit opens only when there is sufficient pressure built up in the condenser. In this way, the compressor (the main power draw) needs to operate only to feed cold liquid, which is matched to the cooling load. Furthermore, the mixed phase regulator 232 regulates the refrigeration cycle through negative feedback, wherein if there is too little subcooling entering the mixed phase regulator 232, the regulator thus passes more vapor, which in turn reduces efficiency of the heat transfer in the evaporator coil 222. This allows the condenser/compressor to further subcool refrigerant, thus rebalancing the load. If there is too much subcooling, the mixed phase regulator operates to provide less vapor, which cascades through the system with a similar but opposite effect, again returning the refrigeration balance to its design point.

In the energy storage mode, the universal refrigerant management vessel 246 feeds liquid refrigerant through liquid line feed 266 to an ice tank heat exchanger 240 that stores the cooling in the form of ice. Upon delivering the cooling to the ice tank heat exchanger 240, mixed-phase refrigerant is returned to the universal refrigerant management vessel 246 via a wet suction return line 224. Dry suction return line 218 returns vapor-phase refrigerant to be compressed and condensed in the condensing unit 202 to complete the thermal energy storage cycle.

In the cooling mode, the universal refrigerant management vessel 246 feeds liquid refrigerant through a pump inlet line 264 to a liquid refrigerant pump 220 which then pumps the refrigerant to an evaporator coil 222 via pump outlet line 260. Upon delivering the cooling to the evaporator coil 222, mixed-phase or saturated refrigerant is returned to the ice tank heat exchanger 240 via a low-pressure vapor line 268 and is condensed and cooled utilizing ice that had been made during energy storage mode. The vapor-phase refrigerant is then returned to the universal refrigerant management vessel 246 via liquid feed line 266.

Figure 3:
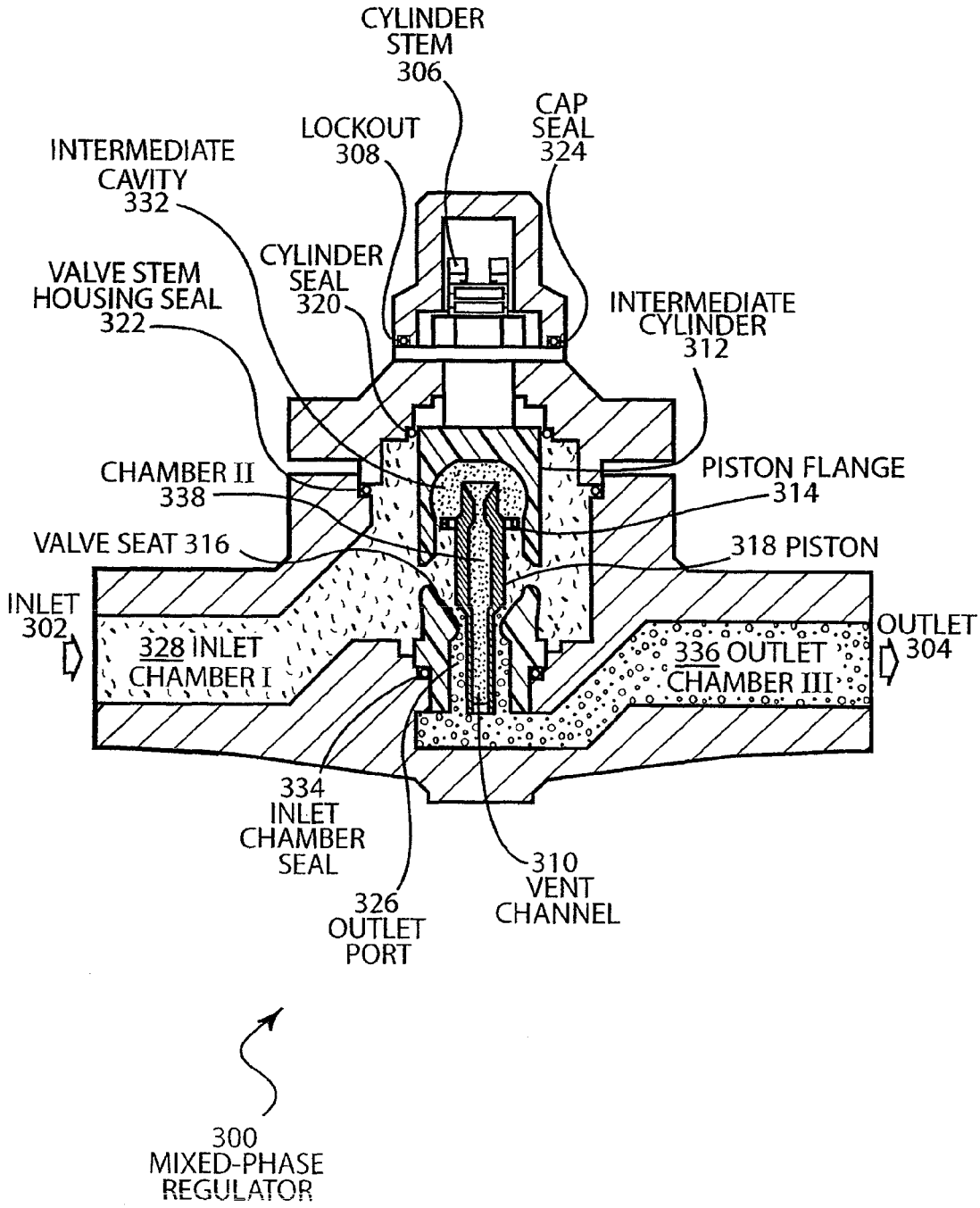
FIG. 3 illustrates an embodiment of a mixed-phase regulator.

FIG. 3 illustrates an embodiment of a mixed-phase regulator 300 used in managing coolant in a refrigerant based high efficiency energy storage and cooling system. As shown in FIG. 3, high-pressure liquid refrigerant (typically from a condensing unit such as 202 shown in FIG. 2) enters the high-pressure side of the mixed-phase regulator 300 at an inlet 302 and accumulates in an inlet chamber 328 (chamber I). A piston 318, which is the main regulating component, slides along a shaft reposed within an intermediate cavity 332. The piston 318 may be of the shape shown, with a piston flange 314 at in an upper portion to increase surface area of pressure manipulation, and a taper at the lower portion. The piston 318 "seats" where the diameter of the piston 318 tapers and rests atop an outlet port 326 during the seated position. Inlet chamber 328 is bounded by a refrigeration inlet 302 on the upstream side and contains a primary outlet at the piston flange 314 that permits flow into an intermediate cavity 332, and contains a secondary outlet through outlet port 326 on the outlet side. Intermediate chamber 338 (chamber II) is bounded by an inlet between the piston flange 314 and the intermediate cylinder 312, and by an outlet at the lower portion of the vent channel 310. Outlet chamber 336 (chamber III) has a primary inlet from the outlet of the intermediate chamber 338 at the vent channel 310, and a secondary inlet at valve seat 316 from the outlet of inlet chamber 328. Outlet chamber 336 is bounded on the outlet side by outlet 304.

When sufficient pressure is acting on the piston 318 from fluid within the inlet chamber 328, the piston 318 is lifted, sufficient pressure having been determined by piston 318 geometry and materials as well as and fluid conditions and pressures of the three cavities acting on the piston 318. The operation of the piston 318 is regulated by a combination of forces (i.e., the pressures in the three chambers and gravitational force). As the piston 318 rises into the intermediate cavity 332, the flow is allowed to pass through an annulus formed between the edge of piston flange 314 and the inside wall of intermediate cylinder 312. During this time, the gap between the piston 318 and the valve seat 316 allows fluid to flow into outlet chamber 336 and through the outlet port 326, dropping the pressure of the fluid traveling from the condenser to the evaporator.

After the piston flange 314 rises into the intermediate cavity 332, the fluid pressure in the intermediate cavity 332 increases to equalize with the pressure inside the inlet chamber 328. This permits gravity and the pressure in the outlet chamber 226 to overcome the pressure in the intermediate chamber (chamber II 338) and move the piston 318 (along with piston flange 314) towards the valve seat 316, which blocks flow through the outlet port 326. At this point, the pressure inside inlet chamber 328 once again rises and the aforementioned process repeats. This rising and falling of the piston 318 occurs at a rapid rate because the total distance over which the piston 318 travels is small. It is this rising and falling (pulsing) of the piston 318 that creates high film heat transfer effectiveness (heat transfer coefficient) in both the evaporator and condenser. This high film heat transfer is created by the pressure waves set up by a hammer effect (pressure pulse) that causes agitation in and between the vapor-phase and liquid-phase refrigerant. As in a partially filled container of soapy water, the vapor bubbles are broken into smaller and smaller units creating a mixed-phase foam. This refrigerant foam greatly increases the surface area (percent of wetted surface) of the refrigerant mixture, and therefore its heat transfer properties.

For example, the piston 318 rises when there is a differential pressure between the inlet 302 (high side—chamber I) and the outlet 304 (low side—chamber III) great enough to overcome the opposing forces, such as the weight of the piston 318 itself. If the entering refrigerant quality is high (mostly vapor content), then the piston flange 314 rises into the intermediate cavity 332 by vapor pressure difference only. Upon rising a short distance, this pressure difference is equalized through the vent channel 310 which permits gravity to pull the piston 318 back into the valve seat 316. The kinetic energy of the rapidly moving fluid stream rising into the inlet chamber 328 and striking the bottom portion of the piston flange 314 provides an additional motive force acting on the system. When the piston 318 is lifted, high-pressure liquid is expelled through the valve seat 316 at decreased pressure. This depletes liquid inside the condenser. Therefore, a proportionally high vapor-content refrigerant flowing into the inlet chamber 328 causes the piston 318 to once again be pulled back by gravity closing the main valve port (outlet port 326).

As liquid flows through valve seat 316 into the outlet port 326 (from chamber I to chamber II), pressure decreases and a portion of this liquid flashes to vapor causing the refrigerant volume to increase. Therefore, the refrigerant velocity increases because this process occurs inside of a system having fixed dimensional constraints. The kinetic energy of this flowing refrigerant stream results in a pressure drop through the eductor thereby assisting the flow of refrigerant into the universal refrigerant management vessel where kinetic energy is converted back to potential energy. This energy conversion assists in the flow of refrigerant through the ice freezing/discharge coils 142 (shown in FIG. 1) during the first time period.

The mixed-phase regulator 300 can be adjusted to achieve pulsation of piston 318 by adjusting the height of the intermediate cylinder 312 relative to the valve seat 316 thereby regulating the net open area for fluid to pass between the piston flange 314 and the inside wall of intermediate cylinder 312. This increases or decreases the net opening size of the intermediate cavity 332, which in turn regulates the pressure differential for pulsing the piston 318. This adjustment can be accomplished by rotating a threaded cylinder stem 306 and locking the assembly in place with lockout 308. In this manner, the valve (orifice) opens only when there is sufficient quantity of liquid residing in the condenser. Therefore, the compressor (the main power draw in energy storage and cooling systems) needs to operate only to feed cold liquid that is matched to the cooling load, thereby increasing system efficiency.

Because the mixed-phase regulator 300 should not leak refrigerant to the ambient air it operates as a closed system. Seals have been incorporated into the adjustment features and the chamber junctions to prevent refrigerant, particularly fluorocarbons such as chlorofluorocarbons (CFCs), hydrochlorofluorocarbons (HCFCs) and the like, from being released from the system into the environment. The intermediate cylinder 312 is sealed to the upper housing by an o-ring cylinder seal 320, and the cylinder stem 306 is sealed from the upper housing utilizing o-ring seal in the form of a cap seal 324. The upper housing of the mixed-phase regulator 300 is sealed to the lower housing, in the area of the intermediate cylinder 312, by a valve stem housing o-ring seal 322. The valve seat is sealed from the lower pressure outlet chamber 336 by an o-ring inlet chamber seal 334.

Figure 4:
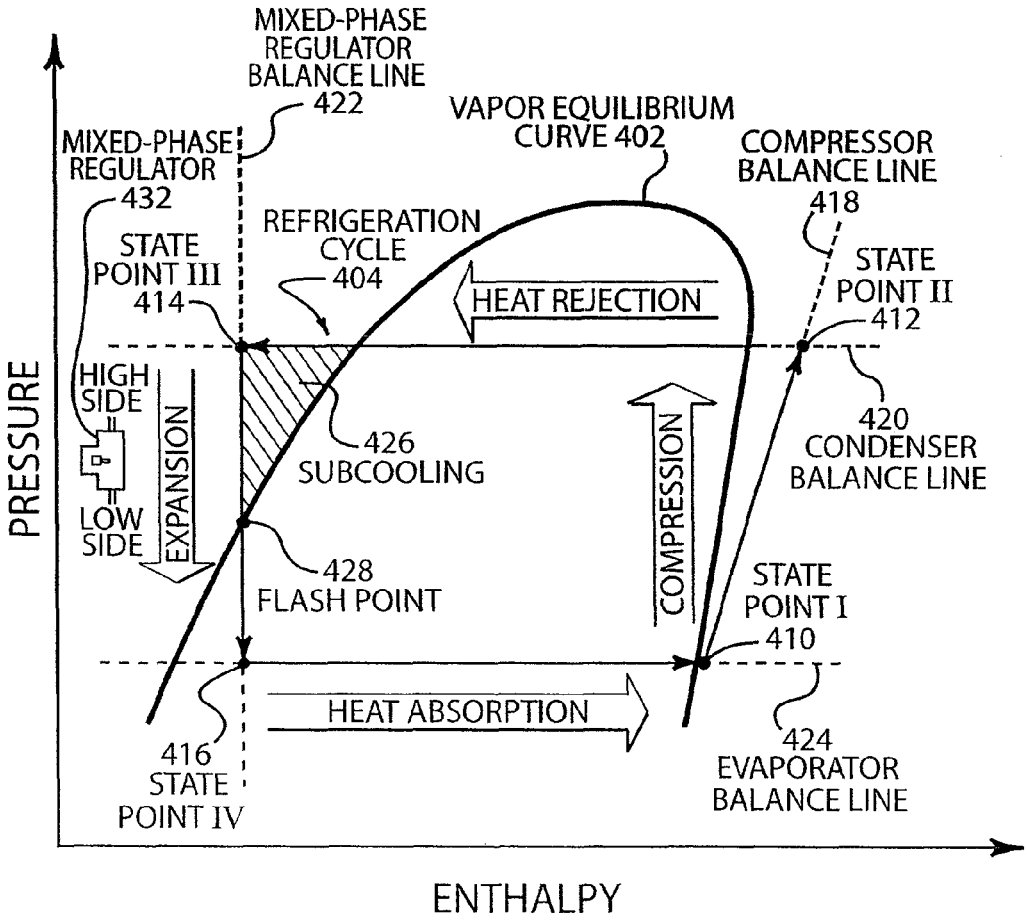
FIG. 4 illustrates a refrigeration cycle for a cooling system that is regulated by a mixed-phase regulator.

FIG. 4 is an illustration of a refrigeration cycle for a cooling system that is regulated by a mixed-phase regulator. As shown in FIG. 4, an enthalpy-pressure diagram details some of the thermodynamic principals for a refrigeration cycle 404 of a mixed-phase regulator such as was detailed in the embodiment of FIG. 3. A vapor equilibrium curve 402 is shown representing points at which the phase of a refrigerant is at equilibrium for a particular pressure and enthalpy. The area under vapor equilibrium curve 402 is therefore mixed-phase refrigerant (both vapor and liquid phase), and the areas outside the curve are single phase refrigerant. To the right of equilibrium curve 402, the refrigerant exists as vapor-phase. To the left of equilibrium curve 402 the refrigerant exists as liquid phase. A refrigeration cycle 404 is overlaid within the vapor equilibrium curve 402 to show the four-step process of the refrigeration cycle of a cooling system. These four steps being: compression, heat rejection, expansion and heat absorption of the refrigerant.

Starting at cycle point I 410 (typically an evaporator coil) the refrigerant within the system is low-temperature, low-pressure, vapor-phase fluid. The refrigerant condition moves from cycle point I 410, to cycle point II 412 along compressor balance line 418, as a result of the action of a compressor upon the refrigerant within the system. The compressor acts to compress the refrigerant vapor that is drawn from the evaporator coil, thereby causing the refrigerant vapor pressure to increase thereby increasing the vapor temperature. The endpoints of the compressor balance line 418 are determined by the condenser and evaporator operating conditions. The path of the compressor balance line 418 is determined by the performance characteristics of the particular compressor and specific refrigerant used within the refrigerant system At cycle point II 412, the refrigerant has become high-temperature, high-pressure single-phase refrigerant vapor (outside and to the right of vapor equilibrium curve 402). This refrigerant is brought from cycle point II 412 to cycle point III 414 along condenser balance line 420 under substantially constant pressure. The path of the condenser balance line 420 is determined mainly by the temperature of the heat sink (medium heated by the refrigerant) and also by the performance characteristics heat exchanger, mixed-phase regulator and the refrigerant. During this process, vapor is pushed into a condenser located in a heat sink that is in thermal communication outside of the cooling system. Inside the condenser, heat is rejected from the refrigerant so that it condenses to a liquid state and the heat is expelled from the system through the heat sink. As the refrigerant is brought to the left of the vapor equilibrium curve 402 within refrigeration cycle 404, sub-cooling 426 of the refrigerant occurs to a point where influence of the mixed-phase regulator regulates the extent to which enthalpy can be removed from the refrigerant (shown as mixed-phase regulator balance line 422). The path of the mixed-phase regulator balance line 422 is determined by the performance characteristics of the particular geometry of the mixed-phase regulator, the type of refrigerant used, and the condenser and evaporator operating characteristics.

The refrigerant at cycle point III 414 is intermediate-temperature, high-pressure, single-phase liquid refrigerant. The mixed-phase regulator, such as depicted in FIG. 3, acts to bring the refrigerant from cycle point III 414, to cycle point IV 416, by expanding the refrigerant within the mixed-phase regulator and by lowering the pressure without changing the energy of the refrigerant. This is represented by mixed-phase regulator balance line 422. In this step of the cycle, the refrigerant pressure is decreased at constant enthalpy by increasing the flow through the mixed-phase regulator until the refrigerant reaches a flash point 428 on the equilibrium curve 402.

As mentioned above, vapor-phase refrigerant within the mixed-phase regulator causes the piston to close while pressure of the high-side refrigerant causes the piston to open. A mixed-phase vapor, therefore, causes a cycling of the piston thereby creating a duty cycle which can be defined as the ratio of piston time open to piston time closed. As shown in FIG. 3, when the piston is open refrigerant passes from chamber 1 to chamber 3 inducing a pressure reduction. When the mixed-phase regulator senses the presence of vapor, or when the flow is such that flashing occurs within the refrigerant, the piston closes and diverts flow from chamber 1 to chamber 2. This cycle repeats, flow is regulated and pressure is reduced within the expansion step. In doing so, the ratio of piston open time to piston closed time (duty cycle) is varied. As the percent vapor content of the refrigerant in the expansion step increases, the duty cycle is also increased. The cooling system is unable to respond to the rapid cycling of the piston, thus, a time average value of the flow, as determined by the duty cycle (percent time open vs. closed) within the mixed-phase regulator is what determines the balance points of the refrigeration cycle. At cycle point IV 416 mixed-phased vapor and liquid refrigerant are at low-temperature and low-pressure (mostly liquid-phase).

The refrigerant at cycle point IV 416 is returned to cycle point I 410 by evaporating the liquid within an evaporator along evaporator balance line 424 to produce cooling. The characteristics of the evaporator balance line 424 are mainly determined by the temperature of the heat source (medium being cooled) and the characteristics of the heat exchanger and the refrigerant. The refrigerant now is back at the beginning of the cycle point I as low temperature, low-pressure vapor-phase refrigerant where the process may begin again.

The mixed-phase regulator acts as a refrigerant circuit controller that allows the return of saturated vapor-phase refrigerant directly to the compressor (without superheating the refrigerant). This is beneficial because conventional evaporators expend excessive space and energy to superheat refrigerant which is avoided with a mixed-phase regulator, thereby allowing the compressor to run cooler and more efficiently. Superheated refrigerant is required with a thermal expansion valve because refrigerant within the superheated region is used as feedback to actually control the valve. If there is no superheat in the system, the thermal expansion valve operation is unstable. A conventional float valve does not have an intermediate chamber (chamber II 338), and hence, does not have sensitivity to refrigerant flashing. The delayed response time of the float valve (both opening and closing) prevents it from effectively regulating refrigeration systems. Also conventional float valves do not accommodate passage of mixed-phase refrigerant causing potential vapor lock.

Numerous advantages are realized in utilizing a mixed-phase regulator to manage coolant in high efficiency energy storage and cooling systems. In a conventional air conditioning system, the evaporator feed is about 15% vapor (by mass, depending upon the refrigerant employed), which is lost capacity. Gravity recirculated or liquid overfeed systems operate through an accumulator which separates the two phases (liquid and vapor) before feeding liquid to the evaporator utilizing the operating pressure differences in liquid static head between the ice freezing/discharge coils 142 and the universal refrigerant management vessel 146 as the motive force. The flash vapor component bypasses the evaporator (ice freezing/discharge coils 142) via the top of the universal refrigerant management vessel 146 and proceeds directly to the compressor 110 via the dry suction line 114.

The aforementioned embodiments can be used to manage refrigerant circuits in thermal energy storage systems as well as a variety of cooling systems for cooling applications such as: air conditioning of residences, retail environments, small commercial buildings, motels, and small transport applications; process cooling of laboratories, clean environments, data processing, and power plants; refrigeration in meat, poultry fish and dairy, fruits, vegetables, juices and beverages; industrial refrigeration like cryogenics, biomedical and low temp applications, and in dehydrating systems; and, energy systems such as geothermal and solar energy systems or the like.

The described embodiments will regulate high volume refrigerant flow without requiring either refrigerant temperature or vapor superheat feedback from the exit of the evaporator coil as well as ensuring that very little vapor passes from the high-pressure to the low-pressure side thereby gaining the efficiency lost in a conventional liquid overfeed system. The mixed-phase regulator additionally allows flexibility in head pressure of condensing units thereby enabling operation at low ambient temperature conditions without any ambient control kits. The device can easily be attuned to a variety of operating conditions while preventing leakage of fluid during adjustments.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The invention claimed is:

1. A closed system for regulating pressure and flow of a refrigerant comprising:

a mixed-phase regulator that regulates pressure of a mixed-phase refrigerant between an inlet of said regulator and an outlet of said regulator with a variable orifice valve, said variable orifice valve comprising: a piston located between said inlet and said outlet of said regulator that reacts to pressure differential within said mixed-phase regulator to open and close two or more orifices disposed between said inlet and said outlet to regulate said pressure of said refrigerant substantially independent of temperature of said refrigerant.

2. The system of claim 1, wherein said variable orifice valve further comprises:

said piston that floats freely, and reacts to pressure differential between upstream pressure of said refrigerant and downstream pressure of said refrigerant within said mixed-phase regulator to open and close said orifices.

3. The system of claim 1, wherein said piston further comprises:

A vent channel that allows limited flow of refrigerant through said piston from an upstream side of said piston to a downstream side of said piston.

4. The system of claim 1, wherein said piston separates a first chamber from a second chamber and third chamber disposed between said inlet and said outlet;

said first chamber having a refrigerant inlet, a primary first chamber outlet and a secondary first chamber outlet, said first chamber that receives incoming higher-pressure refrigerant through said refrigerant inlet and distributes said incoming refrigerant to said primary first chamber outlet and said secondary first chamber outlet;

said second chamber having a second chamber inlet and a second chamber outlet, said second chamber inlet that is in fluid communication with said primary first chamber outlet, said second chamber that allows flow of said incoming refrigerant from said primary first chamber outlet to a primary third chamber inlet; and, said third chamber having said primary third chamber inlet and a secondary third chamber inlet and a refrigerant outlet, said primary third chamber inlet that is in fluid communication with said second chamber outlet and said secondary third chamber inlet that is in fluid communication with said secondary first chamber outlet, said third chamber that receives and combines refrigerant from said second chamber outlet, and pressure refrigerant within said third chamber to form a effluent low-pressure refrigerant.

5. The system of claim 1, wherein a duty cycle of said opening and closing of said two or more orifices disposed between said inlet and said outlet is adjustable.

6. The system of claim 1, wherein the distance of travel of said piston is adjustable.

7. The system of claim 1, wherein said refrigerant is a fluorocarbon.

8. The system of claim 1, wherein said refrigerant is a naturally occurring refrigerant.

9. A method of controlling pressure and flow of a refrigerant in a closed system comprising:

controlling the flow of said refrigerant through a mixed-phase regulator between an inlet of said controller and an outlet of said controller;

opening and closing two or more orifices disposed between said inlet and said outlet with a piston that reacts to a pressure differential of said refrigerant within said mixed-phase regulator thereby regulating pressure of said refrigerant substantially independent of the temperature of said refrigerant.

10. The method of claim 9, further comprising the steps of:

separating a high-pressure first chamber from an intermediate-pressure second chamber and a low-pressure third chamber with said piston, said piston that allows flow from said first chamber to said second chamber, and regulates flow from said first chamber to said third chamber by reacting to the pressure of said refrigerant;

receiving a high-pressure refrigerant with a refrigerant inlet of said first chamber;

receiving a first portion of said high-pressure refrigerant from said first chamber with said second chamber when there is positive differential pressure between said first chamber and said second chamber, thereby reducing the pressure of said high-pressure refrigerant within said chamber two and creating an intermediate-pressure refrigerant;

receiving said intermediate-pressure refrigerant from said second chamber with said third chamber when there is positive differential pressure between said second chamber and said third chamber, thereby reducing the pressure of said intermediate-pressure refrigerant within said third chamber and creating a first low-pressure refrigerant;

receiving a metered portion of said high-pressure refrigerant from said first chamber with said third chamber when there is positive differential pressure between said first chamber and said third chamber, thereby reducing the pressure of said high-pressure refrigerant within said third chamber and creating a second low-pressure refrigerant; and, combining existing said first low-pressure refrigerant and existing said second low-comprising:

means for controlling the flow of said refrigerant through a mixed-phase regulator between an inlet of said controller and an outlet of said controller;

means for opening and closing two or more orifices disposed between said inlet and said outlet with a piston that reacts to a pressure differential of said refrigerant within said mixed-phase regulator thereby regulating pressure of said refrigerant substantially independent of the temperature of said refrigerant.

11. A closed system for regulating pressure and flow of a refrigerant comprising:

means for controlling the flow of said refrigerant through a mixed-phase regulator between an inlet of said controller and an outlet of said controller;

means for opening and closing two or more orifices disposed between said inlet and said outlet with a piston that reacts to a pressure differential of said refrigerant within said mixed-phase regulator thereby regulating pressure of said refrigerant substantially independent of the temperature of said refrigerant.

* * * * *